United States Patent [19]

Mollet et al.

[11] 4,250,847

[45] Feb. 17, 1981

[54] METHOD AND APPARATUS FOR LIMITING THE ACTION OF A MANUAL CHOKE BY THE RECIRCULATION OF EXHAUST GASES

[75] Inventors: Philippe Mollet, Villebon sur Yvette; Henri Milliot, Arpajon, both of France

[73] Assignee: Regie Nationale des Usines Renault, Boulogne-Billancourt, France

[21] Appl. No.: 37,944

[22] Filed: May 9, 1979

[30] Foreign Application Priority Data

May 9, 1978 [FR] France ..... 78 13610

[51] Int. Cl.[3] ..... F02B 47/08

[52] U.S. Cl. ..... 123/568

[58] Field of Search ..... 123/119 A, 119 F, 1

[56] References Cited

U.S. PATENT DOCUMENTS

| | | | |
|---|---|---|---|
| 1,558,590 | 10/1925 | Carlson | 123/119 F |
| 3,512,509 | 5/1970 | Daigh | 123/119 A |

FOREIGN PATENT DOCUMENTS

| | | | |
|---|---|---|---|
| 2022911 | 5/1970 | Fed. Rep. of Germany | 123/119 A |
| 2550826 | 12/1975 | Fed. Rep. of Germany | 123/119 A |

*Primary Examiner*—Wendell E. Burns

*Attorney, Agent, or Firm*—Oblon, Fisher, Spivak, McClelland & Maier

[57] ABSTRACT

A method and apparatus for the limitation of the action of a manual choke by the recirculation of exhaust gases to the intake manifold is disclosed. A vacuum valve is located in a conduit connecting the intake and exhaust manifolds. The vacuum valve is activated by a vacuum transmitted through a conduit connected with the carburetor. The conduit is selectively opened by an electrovalve. The electrovalve receives a signal to open the conduit when the manual choke is activated and an engine temperature sensor indicates that the engine temperature has exceeded a predetermined value. A time delay circuit may delay the sending of the signal to the electrovalve.

3 Claims, 1 Drawing Figure

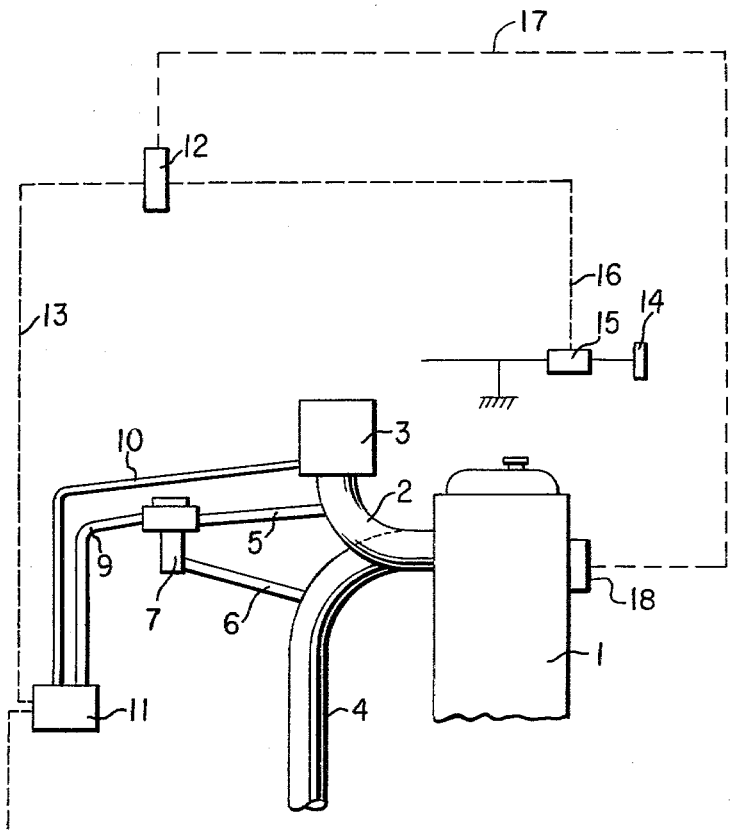
17
12
16
14
15
13
3
10
2
5
9
7
6
18
1
11
4

METHOD AND APPARATUS FOR LIMITING THE ACTION OF A MANUAL CHOKE BY THE RECIRCULATION OF EXHAUST GASES

BACKGROUND OF THE INVENTION

1. Field of the Invention

The present invention, relates to an method and apparatus for limitation of the action of a manual choke by recirculation of exhaust gases to the intake.

2. Description of the Prior Art

The harmful effects of excessive operation of a choked motor are familiar, viz. abundant emission of pollutants and overheating of the engine. Such a situation can arise, for instance, when a driver in a cold country starts the engine in his vehicle before driving off and lets it warm up for a while in his absence.

SUMMARY OF THE INVENTION

The object of the present invention is to alleviate the above drawbacks by diluting, at the opportune moment, the too rich mixture reaching the engine.

BRIEF DESCRIPTION OF THE DRAWINGS

The invention will be illustrated by way of a nonrestrictive example with reference to the single attached FIGURE which represents a schematic view of an embodiment apparatus of the invention.

DETAILED DESCRIPTION OF THE PREFERRED EMBODIMENTS

Abutting the motor 1 are the extremities of an intake manifold 2, coming from a carburetor 3, and an exhaust manifold 4.

The intake and exhaust manifolds, 2 and 4, may be put into communication by the intermediary of pipes 5 and 6, respectively, connected to a vacuum valve 7 which determines whether or not the passage between the said pipes 5 and 6 is open.

The valve 7, of straightforward type, is of the sort using as actuating force a vacuum such as that existing in the carburetor 3, to which it is connected by the tubing 9-10.

An electrovalve 11, interposed between these, permits blocking communication between the line 9–10, according to whether it is excited or not. This excitation is a pulse provided by the device 12 via the circuit 13, itself activated when the driver pulls the choke control 14 thanks to a contact 15 which closes an electric circuit 16. The device 12 may be of the delay type or active depending on the temperature of the motor, to which it is then connected by a complementary circuit 17 and a detector sensitive to heat, such as a bimetallic strip 18.

The operation of the arrangement of the invention is as follows:

When the driver pulls the choke 14 he simultaneously closes an electric circuit via the contact 15 and, doing this, arms the device 12. The motor is then started, the motor 1 being fed a rich mixture from the carburetor 3 via the intake manifold 2.

After a running time, variable according to various parameters, the initial mixture, becoming too rich for the existing conditions, starts to overheat the motor. The detector 18 of the device 12 then transmits a signal causing operation of the eletrovalve 11. This applies the vacuum of the carburetor to the vacuum valve 7 which consequently opens the passage between the exhaust manifold 4 and the intake manifold 2, causing dilution, by a fraction of the exhaust gases, of the too rich mixture coming from the carburetor 3. The fraction of exhaust gases thus diverted is determined by various known means such as, for example, suitable nozzles disposed in the pipes 5–6.

When the driver pushes the choke knob back in, he deactivates the various electric means, described above, returning the carburetor operation to its normal control of the situation.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for controlling the richness of the mixture in an internal combustion engine having a carburetor, a manual choke, intake and exhaust manifolds, and means for selectively circulating a portion of the gases in said exhaust manifold into said intake manifold, said method comprising:

activating the manual choke to enrich said mixture;

sensing the temperature of said engine;

sensing said activation of said manual choke; and diluting said enriched mixture by activating said means for selectively circulating in response to said first and second recited sensing steps when said temperature exceeds a predetermined value and said choke is activated.

2. An apparatus for controlling the richness of the mixture in an internal combustion engine having a carburetor, intake and exhaust manifolds, and a manual choke, said apparatus comprising:

a first conduit connected between said intake and exhaust manifolds;

a vacuum valve in said conduit, said valve being open so as to open said first conduit when said valve is subjected to a vacuum;

a second conduit connected between said vacuum valve and a vacuum source in said carburetor;

an electrovalve in said second conduit, said electrovalve being open so as to open said second conduit when subjected to an electric signal; and means activated by said choke and the temperature of said engine for transmitting an electric signal to said electrovalve.

3. The apparatus of claim 2 wherein said means for transmitting an electric signal includes means for delaying the transmission of said signal for a predetermined period of time.

* * * * *